United States Patent [19]

Kleineke

[11] Patent Number: 5,073,065

[45] Date of Patent: Dec. 17, 1991

[54] MINE ROOF BOLT WITH RESIN RETENTION AND RESIN MIXING DEVICE

[75] Inventor: Charles W. Kleineke, Rayland, Ohio

[73] Assignee: Advanced Mining Systems, Inc., Steubenville, Ohio

[21] Appl. No.: 623,071

[22] Filed: Dec. 6, 1990

[51] Int. Cl.[5] ..... E21D 20/02

[52] U.S. Cl. ..... 405/259.6; 405/259.5; 401/82

[58] Field of Search ..... 405/259, 260, 261; 411/82, 258; 52/704

[56] References Cited

U.S. PATENT DOCUMENTS 4,305,687 12/1981 Parker ..... 405/260
4,516,886 5/1985 Wright ..... 405/261
4,865,489 9/1989 Stankus et al. ..... 411/82

FOREIGN PATENT DOCUMENTS 1232538 1/1967 Fed. Rep. of Germany ..... 405/261

*Primary Examiner*—Dennis L. Taylor
*Attorney, Agent, or Firm*—Fleit, Jacobson, Cohn, Price, Holman & Stern

[57] ABSTRACT

A mine roof bolt is provided including a tapered shoulder portion extending from a terminal threaded portion to a main body portion. The threaded portion includes a locking mechanism for mechanically engaging the side walls of a mine roof bore. A resin retention and resin mixing device rests on the tapered shoulder portion of the mine roof bolt to aid in chemically bonding the bolt to the mine roof bore.

6 Claims, 2 Drawing Sheets

MINE ROOF BOLT WITH RESIN RETENTION AND RESIN MIXING DEVICE

FIELD OF THE INVENTION

A mine roof bolt is disclosed having a resin retention and resin mixing device mounted on a tapered shoulder of the bolt.

BACKGROUND OF THE INVENTION

For some time, mine roof bolts have been used with a mechanical anchoring device and resin grout to provide both a mechanical anchoring and chemical bonding with a mine roof bore. A stopper washer has been located on the mine roof bolt with an inner diameter of the stopper washer about equal to the diameter of the bolt and an outer diameter of the stopper washer substantially equal to the diameter of the mine roof bore so that the stopper washer stops the flow of resin down the bolt. These washers confine the resin and produce a dense resin column along a length of the bolt between the top of the mine roof bore and the stopper washer.

Examples of the use of stopper washers are disclosed in U.S. Pat. No. 4,419,805 to Calandra, Jr., and U.S. Pat. No. 4,865,489 to Stankus et al.

In U.S. Pat. No. 4,419,805 to Calandra, Jr., a metal washer is described as being retained on a bolt to effectively retain the volume of a resin mixture above the washer in surrounding relation with the bolt and its mechanical locking assembly. The washer is either welded or press fit on the bolt and spaced a preselected distance below the bolt threaded portion. In another embodiment, the washer is fabricated of an elastomeric material which is retained in gripping engagement on the bolt below the threaded end portion to retain resin mixture above the washer.

In U.S. Pat. No. 4,865,489 to Stankus et al., an adjustably securable annular washer is mounted on a shaft of a mine roof bolt. The annular washer is fixed in a position so that when a resin capsule is ruptured to release resin to bind the roof bolt within a bore hole, the resin completely fills the bore hole from the blind end of the bore to the rigid annular washer fixed to the shaft of the roof bolt. The annular washer is axially adjustable so that the roof bolt may be utilized with varying amounts of resins while still causing the resin to be subjected to a compressive force within the bore hole and in the space between the end of the bore hole and the annular washer.

A problem associated with the use of a stopper washer mounted on a mine roof bolt is that it is difficult to obtain a flat washer of the proper inner and outer diameters. The stopper washer must have an inner diameter about equal to the diameter of the bolt and an outer diameter substantially equal to the diameter of the mine roof bore. These stopper washers have to be specially made for use with a specific mine roof bolt used with a specific diameter mine roof bore. Also, the stopper washer does not assist in retaining the bolt in the bore hole.

SUMMARY OF THE INVENTION

In the present invention, a mine roof bolt includes a tapered shoulder portion tapering from a reduced diameter terminal threaded portion to a greater diameter main body portion. The threaded portion includes a locking mechanism for mechanically engaging the side walls of a mine roof bore. A resin retention and resin mixing device rests on the tapered shoulder portion of the mine roof bolt to aid in chemically bonding the bolt to the mine roof bore.

The inner diameter of the resin retention and resin mixing device is less than the diameter of the main body portion of the bolt and greater than the diameter of the threaded portion of the bolt. The resin retention and resin mixing device may be a lock washer resting on the tapered shoulder portion to slow down resin which is flowing along the bolt and to mix components of the resin as the resin flows past the device. Lock washers are widely available at low cost and are easy to mount on the mine roof bolt of the invention.

The resin is released during rupturing of a resin cartridge located above the mine roof bolt and at the top of the mine roof bore. The outside diameter of the lock washer is less than that of the mine roof bore so as to allow resin, as it flows along the bolt, to pass around the lock washer in an annular space between the lock washer and the mine roof bore for additional mixing of the resin and for securing the lock washer in the hardened resin. Once the resin is set, the lock washer is embedded in the resin and aids in the pull resistance against removal of the bolt from the roof bore.

It is therefore an object of the present invention to provide a resin retention and resin mixing device on a tapered shoulder of a mine roof bolt.

It is another object of the present invention to provide a resin retention and resin mixing device on a tapered shoulder of a mine roof bolt for slowing flow of resin along the bolt and for mixing of components of the resin as the resin moves in contact with and beyond the resin retention and resin mixing device for a chemical bonding of the bolt in a mine roof bore.

It is yet another object of the present invention to provide a resin retention and resin mixing device on a tapered shoulder of a mine roof bolt for slowing flow of resin along the bolt and for mixing of components of the resin as the resin moves in contact with and beyond the resin retention and resin mixing device for a chemical bonding of the bolt in a mine roof bore and with a locking device located on a terminal threaded portion of the bolt for mechanical locking of the bolt in a mine roof bore.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
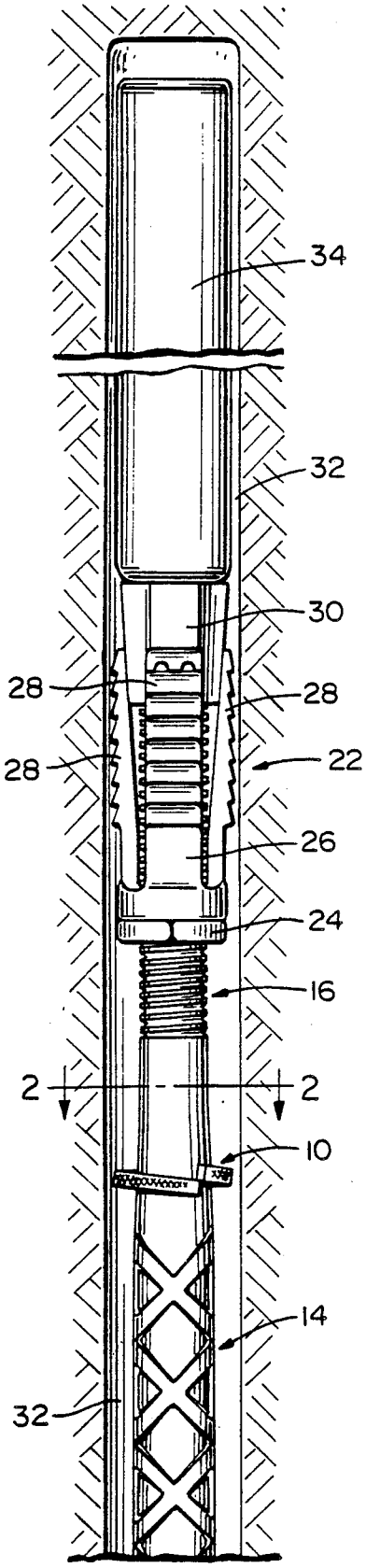
FIG. 1 is a side elevational view of a mine roof bolt having a resin mixing and resin retention device which is located below a resin cartridge in a mine roof bore.
Figure 3:
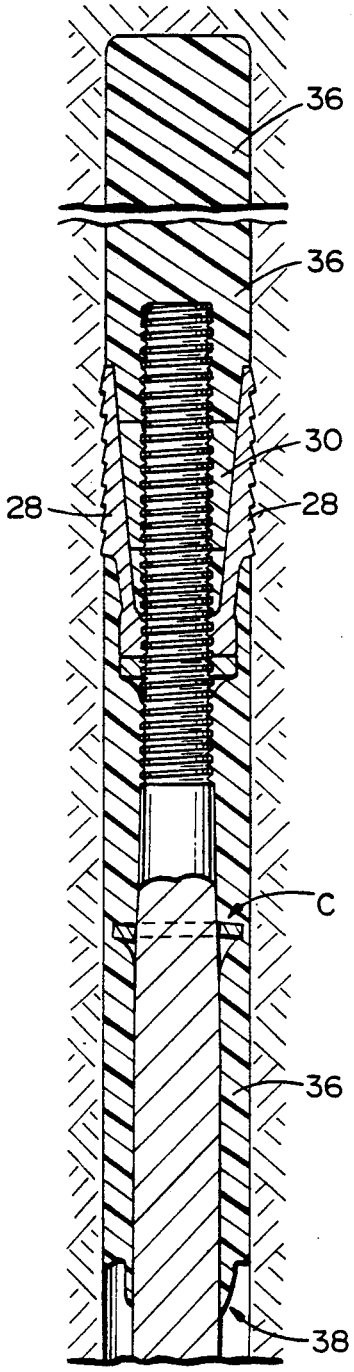
FIG. 3 is a sectional view of the mine roof bolt and resin mixing and resin retention device after destruction of the resin cartridge and setting of the resin components.
Figure 4:
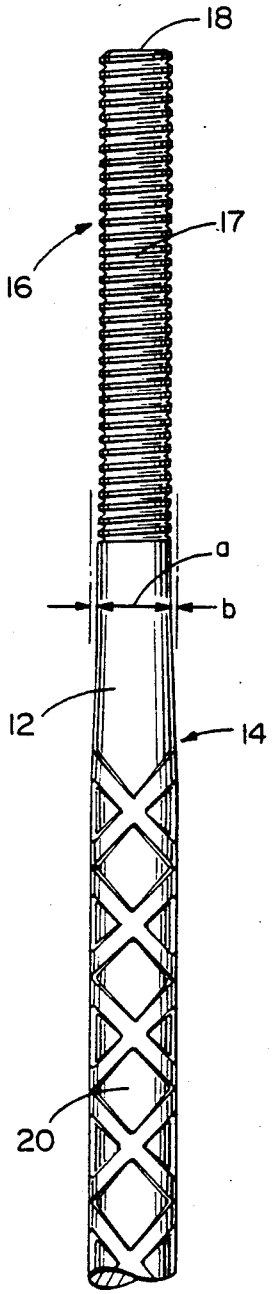
FIG. 4 is a side elevational view of a mine roof bolt.
Figure 2:
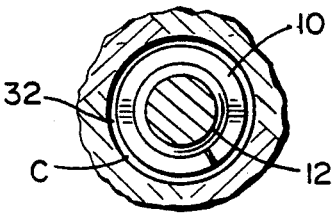
FIG. 2 is a sectional view taken along line 2—2 of FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 5 in particular, a resin mixing and resin retention device is generally designated as 10. The device 10 is mounted on a swaged shoulder portion 12 of a mine roof bolt 14. The swaged shoulder portion is located between a threaded portion 16 located at a terminal end 18 of the mine roof bolt 14 and a main body portion 20 of the mine roof bolt. The swaged shoulder portion tapers to increase in diameter from the diameter "a" of the threaded portion 16 to the diameter "b" of the main body portion 20 of the mine roof bolt 14.

In the manufacture of the mine roof bolt 14, a bolt has several inches of the terminal end 18 of the bar swaged by forging, squeezing or hammering to taper along shoulder portion 12 from the larger diameter of the main body portion 20 to a constant reduced diameter at the terminal end. The terminal end of the bolt is then formed with threads 17.

In use, a mechanical locking assembly 22 is mounted on the threaded portion 16 of the bolt 14. The mechanical locking assembly includes a nut 24 threaded on the threaded portion 16. Located above the nut 24 is a shell member 26 having a plurality of leaves 28 which are expandable upon axial movement of a threaded plug 30. Rotation of the bolt 14 causes the plug 30 to move axially downward into slidable engagement with the leaves 28 to force the leaves 28 laterally outwardly into engagement with the side walls of a mine roof bore 32.

As shown in FIG. 1, a resin cartridge 34 is located at the top of the bore. The resin cartridge 34, as is known in the art, contains a conventional two component resin and catalyst material, which upon mixture, forms a settable material which flows by gravity until setting and hardening.

To break the resin cartridge 34, the mine roof bolt 14, with device 10 and mechanical retention assembly 22 mounted on an end of the bolt, is non-rotatably inserted into the bore 32. The upward contact of the bolt with the resin cartridge 34 causes rupture and mixing of the components of the resin cartridge.

The bolt 14 is then rotated to cause the plug 30 to move axially downward along the threads 17 of the threaded portion 16 to laterally force the leaves 28 into engagement with the side walls of the bore 34 so as to mechanically lock the mine roof bolt 14 to the side walls of the bore. Simultaneously, the mixed resin 36 forced from the resin cartridge 34 begins to flow downwardly through the gaps formed between adjacent leaves 28 of the mechanical retention assembly 22.

At a distance of typically about one inch below the threaded portion 16 is located the device 10 on tapered shoulder portion 12. Upon contacting the device 10, the resin is caused to slow down in its flow along the bolt. The outer diameter of the device is less than the diameter of the bore hole 32, by approximately $\frac{1}{4}$ inch as indicated at "c" in FIG. 3. In a typical $1\frac{3}{8}$ inch diameter bore hole, the device 12 will therefore have an outer diameter of $\frac{7}{8}$ inch. The flow of resin through the annular gap having the dimension "c" formed between the device and the bore hole causes additional mixing of the resin components Eventually, the resin will flow in a lowermost position indicated at 38 and the resin 36 will harden.

Figure 5:
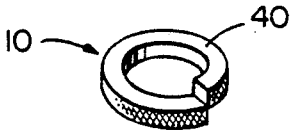
FIG. 5 is a perspective view of a resin mixing and resin retention device.

In FIG. 5, the device 10 is shown as being a lock washer 40 having an inner diameter greater than the diameter of the threaded portion 16 and having an inner diameter less than the diameter of the main body portion 20 of the bar 14. The outer diameter of the lock washer 40 is approximately $\frac{7}{8}$ of an inch or will be of an outer diameter to form an annular gap of approximately $\frac{1}{4}$ inch between the lock washer 40 and the side walls of the mine hole bore 32.

Figure 6:
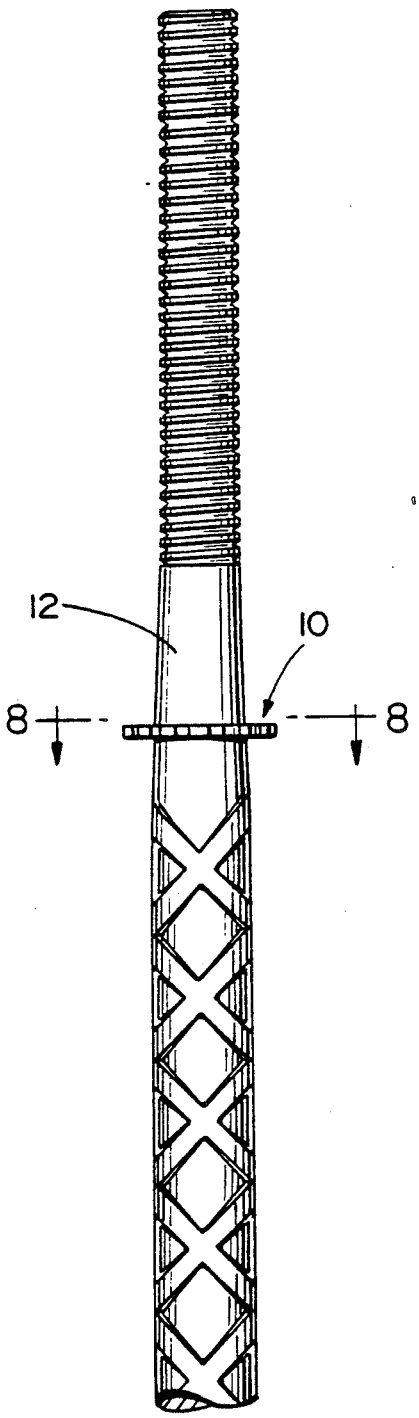
FIG. 6 illustrates a mine roof bolt with an alternate embodiment of a resin mixing and resin retention device.
Figure 7:
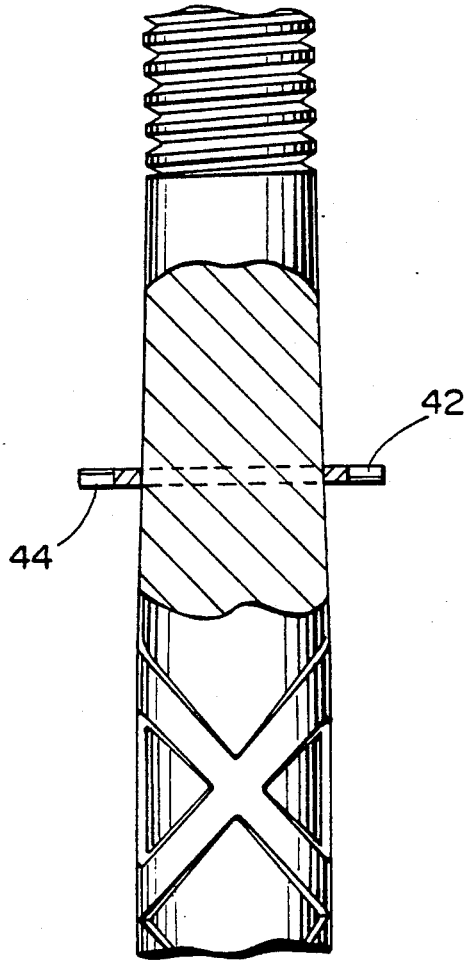
FIG. 7 is an enlarged, partial sectional view of the resin mixing and resin retention device of FIG. 6 mounted on a mine roof bolt.
Figure 8:
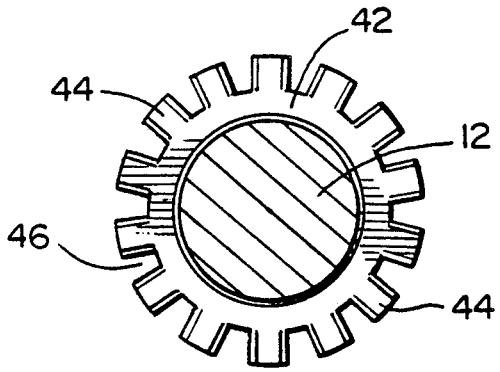
FIG. 8 is a sectional view taken along line 8—8 of FIG. 6.

In FIGS. 6 through 8, an alternate embodiment of the resin mixing and resin retention device 10 is a lock washer 42, again having an inner diameter greater than the threaded portion 16 and an inner diameter less than the diameter of the main body portion 20.

The lock washer 42 includes a plurality of radially extending projections 44 which are spaced about the outer periphery of the lock washer and which are separated from each other by a gap 46. When the lock washer 42 is used as a resin mixing and resin retention device, the resin flowing into contact with the lock washer 42 to cause a further mixing of the resin by forcing a portion of the resin down between the projections 44 (through the gap 46) as the resin flows past the lock washer 44. As with lock washer 40, lock washer 44 slows down the resin moving along the bolt and is embedded in the hardened resin so as to aid in pull resistance for removal of the bolt from the mine roof bore.

As would be appreciated by one of ordinary skill in the art, although not illustrated, the mine roof bolt of the invention would be used in combination with a mine roof plate and have a headed end. The threaded bolt used would be typically of construction grade and is commercially available in various diameters and called "rebar". The terminal portion of the bolt is usually threaded for approximately $4\frac{1}{2}$ to $5\frac{1}{2}$ inches. The shell and nut used are also commercially available. The lock washers used are selected dependent on the size of the bolt used.

Having described the invention, many modifications thereto will become apparent to those skilled in the art to which it pertains without deviation from the spirit of the invention as defined by the scope of the appended claims.

I claim:

1. A mine roof support assembly comprising:

a mine roof bolt having a main body portion of a predetermined diameter, a terminal portion having a diameter less than said main body portion and a tapered shoulder portion extending between said terminal portion and said main body portion, said terminal portion being threaded, a resin mixing and resin retention device located on said tapered shoulder portion and having an annular configuration with an inner diameter greater than the diameter of said terminal portion and less than the diameter of said main body portion, and lock means mounted on said terminal portion for engaging a sidewall of a mine roof bore upon rotation of said bolt so as to mechanically lock said bolt in the bore.

2. A mine roof support assembly as claimed in claim 1, wherein said device has an outer diameter greater than the diameter of said main body portion.

3. A mine roof support assembly as claimed in claim 1, wherein said tapered shoulder portion is swaged.

4. A mine roof support assembly comprising:

a bolt having a main body portion of a predetermined diameter, a terminal portion having a diameter less than said main body portion, and a tapered shoulder portion extending between said terminal portion and said main body portion, said terminal portion being threaded, resin mixing and resin retention means mounted on said tapered shoulder portion for slowing the flow of resin along said bolt and for mixing of components of the resin as the resin moves in contact with and beyond said resin mixing and resin retention means, and lock means mounted on said terminal portion for engaging a sidewall of a mine roof bore upon rotation of said bolt so as to mechanically lock said bolt in the bore.

5. A mine roof support assembly as claimed in claim 4, wherein said means includes an inner diameter less than said main body portion and greater than said terminal portion.

6. A mine roof support assembly as claimed in claim 4, wherein said device has an outer diameter greater than the diameter of said main body portion.

* * * * *